US005330294A

United States Patent [19]

Guesnon

[11] Patent Number: 5,330,294

[45] Date of Patent: Jul. 19, 1994

[54] RISER FOR A GREAT WATER DEPTH

[75] Inventor: Jean Guesnon, Saint Germain En Laye, France

[73] Assignee: Institut Francais Du Petrole, Rueil Malmaison Cedex, France

[21] Appl. No.: 7,764

[22] Filed: Jan. 22, 1993

Related U.S. Application Data

[63] Continuation of Ser. No. 598,928, Oct. 17, 1990, abandoned.

[30] Foreign Application Priority Data

Oct. 17, 1989 [FR] France ..... 89/13549

[51] Int. Cl.[5] ..... E21B 7/12

[52] U.S. Cl. ..... 405/224.2; 405/223.1; 405/224; 166/350; 166/367

[58] Field of Search ..... 405/195.1, 203, 223.1, 405/224, 224.2, 224.3, 224.4; 175/5, 7; 166/350, 359, 367

[56] References Cited

U.S. PATENT DOCUMENTS

| | | | |
|---|---|---|---|
| 3,705,432 | 12/1972 | Watkins | 405/224.2 X |
| 3,729,756 | 5/1973 | Cook et al. | 405/224.2 X |
| 3,981,357 | 9/1976 | Walker et al. | 405/224.2 X |
| 4,040,264 | 8/1977 | Neilon | 405/224.2 |
| 4,102,142 | 7/1978 | Lee | 405/224.2 |
| 4,176,986 | 12/1979 | Taft et al. | 405/224.2 X |
| 4,291,772 | 9/1981 | Beynet | 175/7 X |
| 4,332,509 | 6/1982 | Reynard et al. | 405/224.2 X |
| 4,431,059 | 2/1984 | Blenkarn et al. | 166/359 |
| 4,466,487 | 8/1984 | Taylor | 175/7 X |
| 4,477,207 | 10/1984 | Johnson | 405/195.1 |
| 4,514,245 | 4/1985 | Chabrier | 156/161 |
| 4,703,813 | 11/1987 | Sieler | 166/359 X |
| 4,821,804 | 4/1989 | Pierce | 166/367 |
| 5,046,896 | 9/1991 | Cole | 405/224.21 X |

FOREIGN PATENT DOCUMENTS 2620956 3/1989 France .

*Primary Examiner*—Dennis L. Taylor
*Assistant Examiner*—John A. Ricci
*Attorney, Agent, or Firm*—Antonelli, Terry, Stout & Kraus

[57] ABSTRACT

A riser adapted to be immersed at a deep water level and including a main tube or an extension tube and peripheral lines. The riser includes at least two of an internal lining of an extension tube, a float only on the upper portion of the extension tube, and/or an extension tube and/or at least one of the peripheral lines having a weight less than that of an equivalent steel tube and/or of an equivalent steel line.

12 Claims, 1 Drawing Sheet

RISER FOR A GREAT WATER DEPTH

This is a continuation of application Ser. No. 598,928 filed Oct. 17, 1990, now abandoned.

FIELD OF THE INVENTION

The present invention relates to a riser for a great water depth. This riser may be used either for drilling or in production applications.

BACKGROUND OF THE INVENTION

Deep sea level drillings, for example, down to 1,000 and, in particular, down to 2,000 m, requires that the architecture of the current risers be reviewed.

The difficulties caused by the transport, maintenance, storage and implementation of numerous elements comprising a riser, the resistance of the tubes of connectors and floats subjected to extremely high static and dynamic stresses which are sometimes hard to detect, as well as the manufacture, use and maintenance of a large volume of mud, would to a large extent reduce the effectiveness, reliability and safety of the drilling system and operations.

The words riser, extension tube or standpipe are understood here to mean a pipe making it possible to transfer, in particular, fluids between the water bottom and an installation situated at an upper level, namely one which may be situated roughly at the water surface or be immersed.

The present invention provides a riser making it possible to work at a great water depth by overcoming the difficulties previously indicated without adversely affecting the effectiveness or reliability of the riser.

For several years, operators have been constantly increasing the diameter of the riser (16"-18⅝- 21) and the BOP working pressure (10,000-15,000 series), the same applying to the use of high density mud (maximum density in question in this analysis being 17 ppg, namely 2.03). This evolution, justified by reasons of safety and effectiveness, more particularly adversely affects the behaviour of the extension tube.

The problems linked to the static dimensioning of the riser appear when a riser longer than 1,000 m is dimensioned according to the prior art.

It has been observed that the internal volume of the riser is greater than the volume of the well itself as soon as the water depth goes down to 1,000 m (for example, the maximum volume of the well, which down to a water depth of 1,246 m, is equal to 164 m3, whereas, the volume of the riser reaches almost 200 m3). It exceeds by double or even triple this volume at a water depth of 3,000 m. This however, presents many serious technical and economic difficulties for the manufacture, storage, maintenance, control and treatment of mud and, finally, there remains the question of safety concerning such drillings.

As the apparent weight of this mud needs to be entirely supported by the tensioners, it follows that the greater the water depth, the greater is the pressure at the top of the riser, even if the actual weight of the riser is nonexistent (in the water).

Consequently, this firstly requires that an installation aboard the surface units has a sufficient tensioning capacity, with regard to the recommendations stipulated in the standards (standard API RP 2Q) currently in force, and secondly the use of tubes which are thicker at the upper portion of the riser so that the stresses there are limited to acceptable values.

Such a dimensioning shows that the ratio between the minimum tension required at the top and the available tensioning capacity would, in many cases, exceed the 71% authorized by the API RP 2Q standard, whereas, the apparent weight of the riser would be assumed as being equal to 0, which conforms neither to reality nor desirability, as it shall be seen further.

Finally, the differential tension generated in the lower section of the riser by virtue of the difference between the maximum density of the mud (dmud=2.03) and that of the seawater (dsw=1.03) here also requires the use of highly-resistant tubes.

These observations actually show the difficulties brought about by the simple static dimensioning of the riser due to the increase in weight and pressure of the mud which is contained there when the water depth increases. It might be imagined that these difficulties could be overcome by simply using sufficiently thick tubes and relatively resistant connectors. Unfortunately, this is not, strictly speaking, true due to the consequences on the floats and, secondly, a worsening of the dynamic behaviour of the riser.

As regards the problems linked to the floats, the following observations may be made:

The overhead minimum tensions mentioned above have been determined, as already stated, by supposing that the weight in water of the riser elements was nil. Such a hypothesis implies that a sufficient number of floats is tied to so as to fully compensate for the weight of the tubes and of the connectors which form them.

Now, it is known that the density of synthetic foam floats, which ordinarily equip the riser elements, is that much greater when the water depth level (and, consequently, the water pressure they need to resist) is high. Below 2,000 m (200 bars), the resistance of these floats is moreover not yet proven and the corresponding costs concerning development, all the more greater since the water depth level is high. qualification and provisioning could be quite high.

Secondly, the external diameter of the floats needs to be less than a certain value, namely about 1.2 m (47 inches), so as to enable the floats to pass into the 125.7 cm (49½ inches) turntable during the maneuvering of the riser. The volume of the floats and, accordingly, the induced buoyancy are thus physically limited. Therefore, in practice, there is a depth below which the synthetic foams no longer fully compensates for the weight of the riser, with this lack of buoyancy needing to be made up for by a greater tensioning installed capacity. This depth may be estimated at about 2,000 m.

As regards the problems linked to the dynamic behavior of the riser, many factors combine in deteriorating the dynamic behaviour of risers when the water depth level increases.

More particularly, when the riser, connected to the well head, is supported by the steady tension cables of a heave compensation system, it has been observed that the dynamic response of this system is less effective when the tension applied is greater. In other words, for a given mud density, the rigidity of the system increases along with the water depth level. It results, at constant heave in an increase of the amplitude of the oscillations of the tension (around the mean tension) in all the sections of the riser which needs to be taken into account in the fatigue resistance calculations of the tubes and connectors.

However, it is when the riser, which is not connected to the top of the well, is suspended under the floating support without decoupling the relative heave movements of this riser and the support in the event of a storm or during operation that the situation is the most troublesome.

Increasing the riser length actually results in an increase proportional to at least its weight. If, in addition, it is firstly considered that the tubes and connectors need, for those reasons specified above, to be more resistant and thus heavier and that, secondly, the higher the density of the floats attached to the tubes and connectors, the greater the ambient water pressure in the floats need to resist, one can clearly understand that the proportionality factor is in fact greater than 1.

This rapid increasing of the riser weight when the water depth increases provokes the emergence of two phenomena, not very significant and often ignored for average and low water depths. These phenemona may then condition dimensioning, and their characteristics, causes and effects need to be carefully analyzed.

More particularly, the increasing of overtensionings due to inertia of the riser during violent storms may provoke the partial or total detensioning of the upper part of the riser and induce there redhibitory bending stresses in correlation with the other movements (breakout movement, skidding) and the direct action of swell.

Additionally, the raising of the actual period of longitudinal vibrations beyond values for which the amplitude of heave is nil could considerably limit, even in relatively calm weather, the maneuvering operations of the riser to the risks it would present.

The problems linked to control of eruptions and to drilling safety are definitively of less importance concerning the conception and dimensioning of the riser with respect to the existing situation for smaller water depths. As regards this field and when the water depth increases, the following stress principles apply.

The working service of the "kill and choke lines" raised to 1,050 bars (15,000 psi) requires the use of thicker tubes which contribute in increasing the weight of the riser and accordingly increasing the problems linked to its dynamic behavior (see above).

The increasing of head losses induced in these lines during eruption control operations renders these operations more delicate and dangerous to carry out.

The distance of the well head and the intense pressure existing in the head render it more difficult to detect the possible presence of gas in the well and act accordingly by closing the valves of the valves wedges in time. The presence of large quantities of gas in the central tube of the riser thus becomes more likely.

This is expressed by the increased need of using materials fully resistant to the corrosion provoked by petroleum effluent and especially by sulphured hydrogen ($H_2S$).

This also results in the risk of seeing this gas, once decompressed, partially or completely filling the inside of the main tube whose wall, not being thick enough to resist the ensuing hydrostatic compression, would not be able to avoid collapse.

The final type of the problems listed above concerns the difficulty of storing on the bridge of the floating supports the large number of elements comprising the riser when its length increases and the factors need to be considered.

Namely, the resistance of the structure of the platform under the storage areas needs to be sufficient so as to support the total weight of these elements (see above).

Moreover, the volume occupied by the elements, having regard to the size of the floats, needs to be compatible with the available locations and with the naval stability of the rig.

Furthermore, the disposition and handling of the riser shall enable it to implement, according to a specifically established order, elements with different characteristics (central tube thickness, density of floats, with etc), these elements being more numerous (4 or When the water depth is greater is greater. The use of means for the automatic handling of the riser elements, becoming increasingly common on modern rigs, needs to be considered.

SUMMARY OF THE INVENTION

The riser for a large water depth, according to the invention comprises a central tube or extension tube and peripheral lines with the riser being characterized in that it exhibits at least two of the following characteristics:

an internal lining of the extension tube, a float on the solo upper section of the extension tube, and/or the extension tube and/or at least one peripheral line having weight less than a weight of a steel equivalent tube and/or of an equivalent steel peripheral line.

Of course, the riser of the invention may exhibit all three of the above characteristics.

The extension tube and/or at least one of said peripheral lines may be at least partly made of a low density metallic material, such as a titanium alloy or/and comprise a composite material.

This weight reduction may be obtained by the hooping reinforcement of at least one section of the extension tube or at least one section of at least one of the peripheral lines.

Hooping reinforcement may be obtained by the winding of a reinforcement strip around at least the section of the extension tube or around at least the section of at least one of the peripheral lines.

The upper section may comprise floats over a maximum length or depth of up to 2,000 m.

The upper section may comprise floats at a length or depth of less than or equal to ⅔rds of the total length of said pipe.

The extension tube may be formed of an assembly of several elements comprising standard bayonnet connectors.

The extension tube may be formed of an assembly of several elements and the riser may comprise a lining of the extension tube, with the lining being embodied by assembling several lining elements, and with each of the lining elements being suspended from a corresponding element of the extension tube.

Thus, the internal lining of the extension tube is no longer regarded as a pipe column lowered into the riser, but as an internal line of each element of the riser gradually placed during the descent of this riser, thus making it possible to resolve most of these difficulties, as described in the French application filed in the name of the Institut Français du Pétrole on the 7 Aug. 1989 and which forms part of this application.

By virtue of the features of the present invention, reliability of mechanical mounting and seal between two consecutive tubes can be obtained by simple assembling (or interlock).

Moreover by virtue of the invention, the lining is only dimensioned for a pressure difference between the inside of the tube and the annular space. It does not virtually operate in traction and is less dynamically stressed. Its weight is therefore reduced, all the more so as buoyancy materials such as, for example, synthetic foams, are able to be placed in the annular space.

Additionally, the type of lining does not require any tensioning, screwing or tightening of the connectors when it is placed into the riser, this enabling a quick and easy installation.

Furthermore, mechanical behavior of the riser/lining assembly of the present invention may, at any moment, be optimized by modifying the nature and pressure of the fluid filling the annular space by virtue of top and bottom communication lines provided to this effect.

Additionally, in the event of intervening on Blow Out safety preventers requiring the lifting of the riser when the lining is in place inside the riser, it is possible to lift, store and relower the riser and lining at the same time, with these operations being able to be effected without the loss of additional time.

In practice, the use of a lining only becomes necessary from a certain water depth depending on the particular data of the case in question, but which is about 2,000 m. It shall be taken into account as follows in the static dimensioning of the riser:

dimensioning of the central tube in the extension tube for operation without lining and the available head tension, with regard to a mud density compatible with the carrying out of the first drilling phases (up to 44.5 cm, namely 17½"), dimensioning of the central tube for operating with lining and the heaviest mud density required for carrying out small diameter drilling phases, and the dimensioning finally retained shall be most high-performing of the two thus obtained.

One of the advantages induced by the use of lining is, as has been seen, freeing a tensioning capacity used up until now so as to support the weight of the mud, which is added to the one resulting from the anticipated increase of the number of tensioners required to equip the drilling rig when its intervention water depth increases. This additional tensioning capacity enables the elimination of the need for suppressing the floats in the lower section of the riser and has a certain number of advantages, namely:

a non-use of floats in water depths where they are less high-performing, more expensive and where their diameter would be greater than the passage diameter in the turntable, a substantial reduction of the total weight of the riser contributing in resolving the problems linked to dynamic behavior (reduction of overtensions) and storage, and increasing the weight of the riser in the water completing the preceding effect so as to effectively and reliably resolve the difficulties brought about by dynamic behaviour (increase of the mean tension).

In practice, this is fixed as an objective to avoid the use of foam floats below a water depth of about 2,000 m, with this depth being a depth when their effectiveness has been proven in operational conditions.

An additional reduction of the weight of the riser may be obtained according to the present invention by, when possible, the resistance of the tubes with respect to the internal pressure with the aid of a hooping reinforcement obtained by winding these under tension around these tubes made of a composite material (glass fibers, Kevlar fibers or carbon fibers coated in a thermoplastic resin) according to a technique described in the U.S. Pat. No. 4,514,245. This technique makes it possible to multiply by one factor equal to at least 2 the circumferential resistance of the tubes without increasing their weight or, conversely, of reducing their weight for a given resistance.

The operating principle of the hooped-reinforced tubes may be illustrated by considering the evolution of the circumferential stresses in the steel tube and in the composite hooped-reinforcement when the internal pressure increases from 0 until the tube explodes. Four main phases may be described.

First under a pressure of nil, the prestressing induced in the steel tube by the strips is all the more greater (in absolute value) since the winding tension and the number of layers ar also large. At the manufacturing stage, this makes it possible to adjust the value of prestressing to the strict requirement justified by the service conditions of the tubes.

Second when the pressure increases, the stresses in the two elements of the tube increases linearly, but generally much quicker in the steel than in the composite owing to the different rigidities of the two materials. This phase is continued until the stress in the steel tube reaches the elastic limit.

Third beyond freeing of the elastic limit in the steel, it is the composite hooped reinforcement which takes up the larger part of the additional forces and which "holds up" the steel tube stopping it from bursting which would occur very quickly if the reinforcement was absent. This phase is continued until the strips rupture, these strips not having any plastic range.

Fourth first bursting occurs once the strips rupture, the steel tube solely by itself being of course unable to withstand the pressure.

Compared with a conventional steel tube, the range of use of the material in terms of stresses is thus extended in two directions.

First in a direction towards the negative values (prestressing effect, the original zero being offset (from—322 MPa in the previous example). In fact, this boils down to artifically increasing the elastic limit of the steel without raising the usual problems of high resistance steels (poor weldability, mediocre resistance to corrosion and fatigue behavior, delicate implementation, high cost). In the previous example, the apparent elastic limit would be greater than 760 MPa, whereas the real value is only 437 MPa (X65 steel).

Second, beyond elastic limit of the steel, it has been seen that there was a significant margin prior to bursting of the tubes (self-hooping effect) which may be turned to account to optimize their dimensioning. Thus, contrary to the case with the normally used criteria, it is possible to use almost all the elastic range of the steel for testing or service operating the tubes, the safety factor required sometimes stipulated by the regulations being induced by the self-hooping effect. Thus, in the previous example, everything is disposed so that the stress in the test pressure (1,575 bars) is only slightly less than the elastic limit, a factor of 1.5 still existing prior to bursting (2,350 bars), whereas, without hooping it would not be possible in identical conditions to exceed 70% of this elastic limit.

This composite hooped-reinforcement technique of the tubes operating at the internal pressure shall be extensively used for the architecture of risers. In particular, it is used for the setting up of the following tubes:

"Kill and choke lines" whose working pressure of 1,050 bars would require the use of steel tubes 1" (25.4 mm) thick. This may be brought down to 10 mm (with the same steel) by virtue of the composite hooped reinforcement. Their total weight (lengthening pieces included) is this divided by a factor 2 at the same time as their internal diameter of the tubes is significantly increased (94 mm instead of 76 mm) so as to facilitate the control of eruptions and contributes in improving the safety of drillings and the main tube in the lower section of the riser. So as to provide the latter with sufficient resistence without increasing the steel thickness, the circumferential stresses in the main tube in the lower section of the riser shall not exceed the limit fixed by API Rp 2Q Standard. The criteria used for the dimensioning of the main tube subsequently in this study shall be the following:

determination of the thickness of the main steel tube solely from the point of view of the longitudinal, static and dynamic, traction and bending stresses, determination of the composite lining reinforcement characteristics so as to provide these tubes with a sufficient resistance with regard to the internal pressure, and verification of the admissible level of Von Mises combined stresses.

The method shall be applied to the lower section of the lining tubes with the difference that in the concept proposed, these tubes do not have to be dimensioned in order to resist the extremely low traction existing at this location. The thickness of the steel tube may thus be reduced to a minimum compatible with operational and industrial requirements.

The lightening of the extension tube by using low density materials enables the previously problems posed to be resolved as best as possible. Such a lightening may be obtained for all or part of the riser by replacing the essential steel of the main tube (tubes and connectors) with a titanium alloy, such as a Ti-6Al-4V type alloy three times more performing if one regards its specific resistance (ratio of the elastic limit to the density) and also more fatigue resistant and more resistant to petroleum and marine corrosion.

Such tubes may be obtained by the following operations:

drawing with the sheet press in a "die/punch" tool so as to obtain semicylindrical moulds, embodiment of elementary tubes by longitudinal welding along two generators of two female moulds, and stubbing by circular welding elementary tubes and extremity pieces so as to obtain the elements of extension tubes.

The French patent application FR-2.620.956 proposes a method to embody a titanium tube.

The titanium tube may be reinforced by composite hooped reinforcement similar to the one described above, and a steel lining, with an identical conception to the one defined earlier shall be deployed over its entire length. This high-performing architecture shall allow for extension of the tube extension concept up to a water depth of at least 12,000 feet (3,600 m) with the reserve that the problems raised by an actual longitudinal vibration specific period equal to or greater than 7 seconds are not prohibitory.

BRIEF DESCRIPTION OF THE DRAWINGS

The present invention shall be more readily understood and its advantages appear more clearly from a reading of the following description of non-restrictive examples illustrated by the accompanying drawings, wherein.

DETAILED DESCRIPTION OF THE PREFERRED EMBODIMENTS

Figure 1:
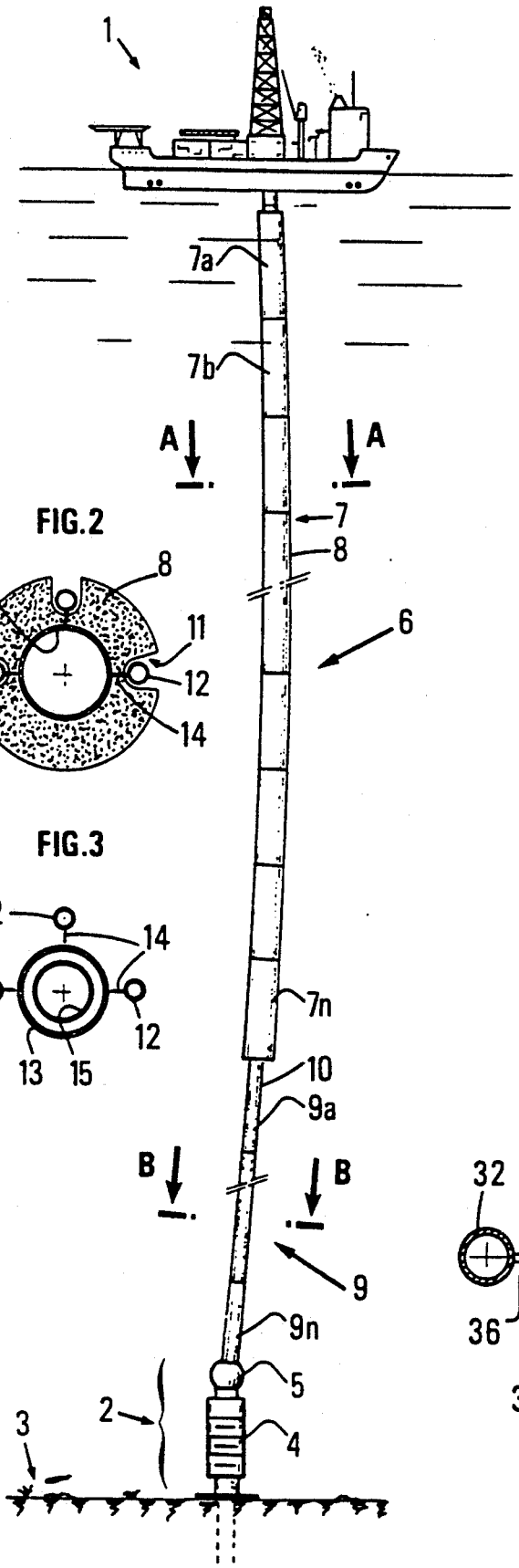
FIG. 1 is a schematic view of an entire riser constructed in accordance with the present invention.

Referring now to the drawings wherein like reference numerals are used throughout the various views to designate like parts and, more particularly, to FIG. 1, according to this figure, a surface installation, for example, a vessel generally designated by the reference numeral 1 is provided from which a riser generally designated by the reference numeral 6 is deployed, with means 3 being provided at a bottom of the water for fixing the riser 6 to a well head 4 by way of a flexible joint 5. The riser 6 includes two sections generally designated by the reference numerals 6 and 7, with the first section 7 being composed of riser elements *7a, 7b . . . 7n* provided with floats 8, and the second riser section 9 not being provided with any float elements and being formed by an assembly of riser elements *9a, 9b . . . 9n.*

Thus, the extension tube of the present invention only comprises floats on the highest section of the riser. By way of example, the presence of floats may be interrupted from depths exceeding 2,000 m. The riser of the present invention or one section of this riser not comprising any float may be made of lightened materials, for example by the use of titanium, a composite material, or by the use of a composite material base hooping for example with the aid of a strip hooping a tube.

The section of the extension tube equipped with a float 8 may intermittently or permanently comprise floats 8. Of course, the floats 8 may be in the surface installation.

Figure 2:
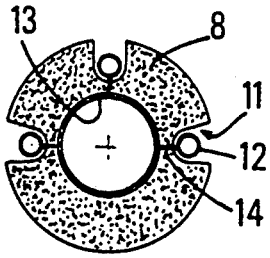
FIG. 2 is a cross sectional view taken along the line II—II in FIG. 1.

FIG. 2 the riser section, not fitted with any internal lining.

As shown in FIG. 2, the float 8 comprises undercuts 11 adapted to receive the peripheral lines 12 with the float 8 being fixed around the main tube 13. In this example, the peripheral lines are secured or integrated with the extension tube 13 by arms 14.

Figure 3:
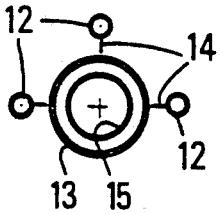
FIG. 3 is a cross sectional view taken along the line III—III in FIG. 1.

FIG. 3 provides an example of the riser at a level where the floats 8 have been eliminated. There are only the peripheral lines 12 fixed to the extension tube 13 by the arms 14.

Moreover, FIG. 3 shows the case of the use of a lining 15 which makes it possible to reduce the amount of mud circulating inside the riser, for example during low diameter drilling. FIG. 3 shows the mud circulating in the internal cylindrical zone 100 and the annular space 101 between the lining 15 and the extension tube 13 shall be free.

These internal lining maya advantageously be embodied in accordance with the patent filed on the 7 Aug. 1989 under the No. EN. 89/10.755 in the name of the Institut Français du Pétrole.

Figure 4:
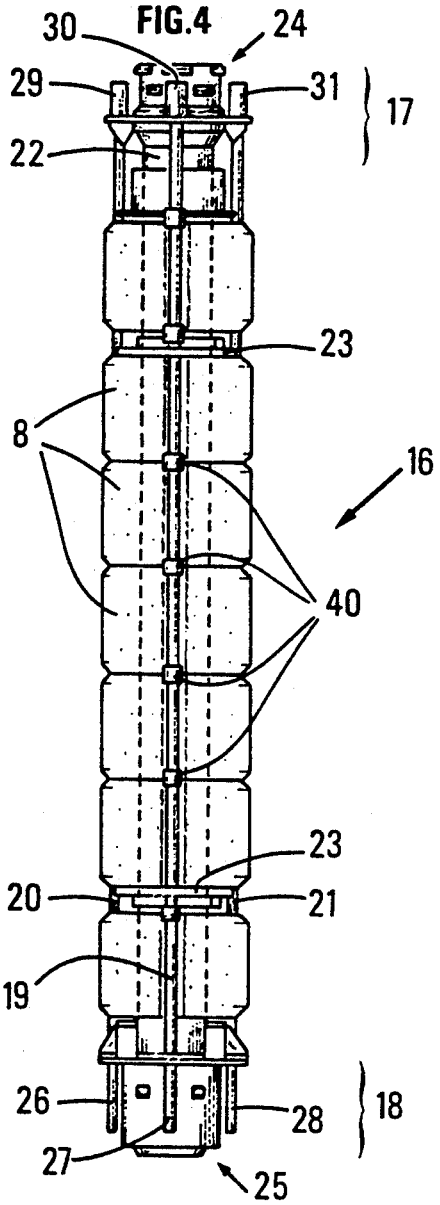
FIG. 4 is a schematic detailed view of an element of the riser of the present invention provided with a means for reducing an apparent weight in water.

FIG. 4 shows one element of the riser, the riser being made up of the assembly of several of these elements, irrespective of whether or not these elements include floats.

In the example shown on FIG. 4, the riser is embodied by the assembly of elements already equipped with their peripheral lines. The reference 16 designates the element in its entirety. This element comprises two extremities 17 and 18. The references 19, 20 and 21 designate peripheral lines which are connected to the extension tube 22 by means of fixing means able to comprise flanges (not shown), plates 23 and collars 40.

The element represented on FIG. 4 comprises floats 8. The assembling of the two adjacent elements is effected by bayonet type connectors 24 and 25. The assembling of two adjacent elements embodies the interconnection of the peripheral lines by connecting the extremities 26, 27 and 28 to the adjacent extremities of the peripheral lines corresponding to the extremities 29, 30 and 31.

Figure 5:
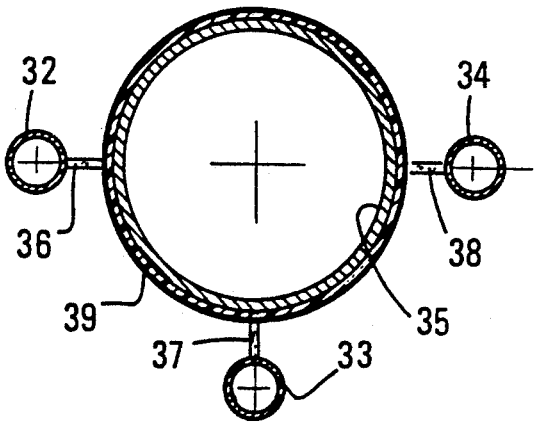
FIG. 5 is a cross sectional view of one element of a riser of the present invention having an extension tube thereof reinforced by an external hooping.

FIG. 5 shows a section of an element composing the riser of the invention.

The peripheral lines bear the references 32, 33 and 34. These peripheral lines are connected to the element of the extension tube 35 by arms 36, 37 and 38. In this embodiment, the element of the extension tube 35 is reinforced by a hooping 39 which may be embodied in accordance with U.S. Pat. No. 4,514,245.

The embodiment combining the assembly of the elements shown on FIGS. 1 to 5 makes it possible to carry out drilling or production operations for water depths exceeding 2,300 m.

Such an embodiment combines the three characteristics making it possible to reach such operation depths.

These characteristics are used by the floats solely on the upper portion of the riser, the use of a lining 15 for one part of the operations using thick mud whose density is close to or greater than two and finally the use of an extension tube 35 or with a weight lighter than the equivalent elements made of steel. This may be obtained by using low density materials, such as titanium, by using a tube made of an organic matrix composite material or any other material, as well as reinforcement by hooping. This latter technique makes it possible to improve the mechanical resistance of a tube be without excessively increasing its weight.

According to the present invention, hooping of the extension tube and/or the peripheral lines 32, 33 and 34 may be embodied.

The hooping 39 makes it possible to have light extension tube elements offering good mechanical performances, particularly to the differences of the pressure existing between the internal portion of these elements and the ambient environment.

Of course, it is possible to remain within the scope of the invention if the extension tube elements are embodied with low density materials, such as titanium, or by embodying them with the air of composite materials, in particular with a reinforced organic matrix by means of fiber glass wires, Kevlar or carbon.

Similarly, according to the present invention, only one portion of the riser may comprise an extension tube, or peripheral lines reinforced by hooping. In fact, such dispositions are required in very deep water levels.

The advantageous effects of the above measures shall be more readily understood on reading the description of a particular application case corresponding to a riser according to the invention and able to operate in a water depth of 3000 m. The main data used in this description are defined as follows:

Water depth: 3,000 m
external diameter of the riser: 533.4 mm (21")
effective length of elements: 22.86 m (75 ft)
peripheral lines:
kill and choke lines (working pressure: 15,000 psi)
booster and hydraulic lines (working pressure: 5,000 psi)
mud maximum density:
1.68 (14 ppg) until laying of 13⅜" pipes
2.03 (17 ppg) and above
dimensioning criteria: API RP 2Q
tensioning capacity: 908t (2,000 kip) utilizable at 71% (645t)
materials used:
8QT steel: (elastic limit: 560 MPa)
Ti-6AL-VV titanium (elastic limit: 830 MPa)
Kevlar fibers and polyamide resin for hooping
Synthetic foams for the floats
Float density:
0.368 (for depths down to 650 m)
0.456 (for depths down to 1,350 m)
0.513 (for depths down to 2,000 m)

The guiding lines used for defining the riser characteristics ensure from the indications already supplied in the present application. The most important of these are described hereafter:

the kill and choke lines have a 93 mm (3.7") internal diameter and are reinforced by composite hooping, one portion of the riser elements has a main titanium alloy tube, which enables their weight to be significantly reduced, The thickness of the main tube is calculated by solely considering the traction and bending longitudinal stresses; the resistance to the circumferential stresses exerted by the pressure is adjusted by an optimized reinforcement of the tube by means of the same composite hooping method, a lining tube is placed inside the riser after the 340 mm (13⅜") pipes are laid; the circumferential resistance of this tube is also increased as a function of requirements by means of composite hooping.

the main stresses (longitudinal), radial and circumferential) and the combined Von Mises stress are limited in ordinary drilling conditions to ⅓rd of the elastic limit of the material forming the main tube, and one portion of the riser elements are equipped with floats so that their apparent weight in water is theoretically nil. However, the use of synthetic foam floats are not used below a water depth of 2,000 m; three elements without floats are also provided at the upper portion of the riser.

The composition of the riser has been defined at the end of a general, static and dynamic analysis with stresses in the main tube. Its main characteristics are given in the following table:

| Number of elements | Material used | Tube thickness | Float density | Float diameter | Effective length | Float weight | Total weight | Apparent weight |
|---|---|---|---|---|---|---|---|---|
| 3 | steel | 19.1 mm | — | — | 69 m | — | 30t | 25t |
| 26 | steel | 19.1 mm | 0.368 | 1.10 | 594 m | 126t | 391t | 0t |
| 29 | steel | 19.1 mm | 0.456 | 1.16 | 663 m | 252t | 547t | 0t |
| 29 | steel | 19.1 mm | 0.513 | 1.21 | 663 m | 252t | 547t | 0t |
| 45 | titanium | 12.7 mm | — | — | 1029 m | — | 248t | 202t |
| 132 | mixed | | | | 3018 m | 580t | 1713t | 227t |

The following additional specific descriptions may be added to the previous data:

Titanium has only been used for the lower 1,000 m of the riser, the steel being retained for the larger length section. Several considerations are at the basis of this choice:

as the cost of titanium tubes is much higher than that of steel tubes, it is important to strictly limit their number;

the total weight of the riser resulting from this architecture is, as shall be seen, sufficiently reduced to give it an acceptable dynamic behaviour in the most severe meteo-oceanographical conditions. A riser whose main tube would be entirely made of titanium and whose weight would accordingly be less than 1,000 t would be recommended for much deeper water levels (down to 3,500 or 4,000 m);

the actual period of the thus defined riser is in each case less than 7 seconds, whereas it would exceed this value if a tube were entirely made of titanium, which could give rise to serious drawbacks.

The connection of the steep elements to the titanium elements would be carried out without any particular difficulty by means of special short joints.

The diameter of the floats has been calculated by supposing that they could cover almost the entire tube of each element and that the presence of the peripheral lines would reduce the effective volume occupied by the foams to 85%. The calculated diameter is thus compatible with the passage of all the elements of the riser in the 49½" (1.26 m) turntable.

The ratio of the apparent weight to the weight of the riser is 13%, which is, as it shall be seen, a sufficient value to provide it with excellent stability and to stop it from its detensioning.

Additional equipments have been taken into account in the following calculations. These are:

a telescopic joint, 30 m long and weighing 20 t, forming the link between the actual riser and the floating support at the time of drilling operations. In the stand-by state, the telescopic joint is removed and the riser is suspended under the support, placed on a turntable or picked up by other means;

an elastic joint forms the linking between the riser and the well head when the first is connected to the second;

the well head comprises, under the joint, the connection joint (weight 125 t) and the 47.6 cm (18¾") BOP—actual 15,000 (weight 225 t). The set of this two equipment items of the solely first are able to be suspended under the riser when the latter is not connected (in operation or on stand-by);

short joints having various functions (length adjustment, steel/titanium connection, measurement joint, filling valve . . . ) may also be present without modifying the following results.

Estimate calculations have shown that the riser of the invention has satisfactory mechanical behavior and is compatible with the safety requirements vital for its operational use.

The angle at the foot of the riser is kept within the 2° limit fixed by the API if the offset at the top does not exceed 1% of the water depth and if the water current is not too strong. In the opposite case, an additional tension of several dozen tons would need to be applied.

These approximate calculations have made it possible to verify that the static, mechanical and dynamic behavior of the riser is fully controlled. All kinds of stresses remain less than one third of the elastic limit, namely, the fixed the maximum value, and the amplitude of overtensions is clearly much less than the mean tension, thus eliminating any risk of detensioning and not stressing the equipment beyond its limits.

This is added to the direct advantages induced by the various measures previously explained, namely, a significant reduction of the volume of mud in the drilling phases where it is heaviest, the suppression of floats where they are least effective and the most expensive, a significant reduction of the weight of the riser elements facilitating their storage and handling on platform bridges, and more efficient safety lines on account of increasing their passage diameter.

All these advantageous factors, rendered largely possible by the intensive use of new materials, undoubtably provides the new architecture of the riser with a remarkable and safe aptitude when used in the deepest water levels envisaged for offshore drillings.

In addition, the nature of the solutions implemented, characterized by a permanent availability and which, contrary to the case with other existing devices, such as air floats or the active tensioning of the riser, do not require any human or material intervention to be effective at the right moment, provides the drilling system with high operational dependability and productivity, thus guaranteeing indispensable profitability for such risky operations, both from the technical and economical points of view.

What is claimed is:

1. A marine riser for installation in a body of water having a great depth, the riser comprising: a central tube means for transferring a fluid including mud from a bottom of the body of water to an upper level thereof;

peripheral lines connected to said riser;

an internal lining disposed in said central tube for reducing an amount of mud circulating in the riser; and a plurality of floats surrounding the central tube and being respectively disposed solely along an axial length of an upper section of the central tube, wherein said internal lining is disposed coaxially with respect to said central tube and has a diameter less than a diameter of said central tube so as to define an annular space between an outer surface of said internal lining and an inner surface of said central tube.

2. Riser according to claim 1, wherein at least one of said central tube and at least one of said peripheral lines has a weight less than an equivalent steel tube or peripheral line.

3. Riser according to any one of claims 1 or 2, wherein said upper section extends over a maximum length of up to 2,000 m, and wherein said plurality of floats are disposed substantially over said maximum length.

4. Riser according to any one of claims 1 or 2, wherein said upper section has a length less than or equal to two-thirds of a total length of said riser, and wherein said plurality of floats are disposed substantially over said entire length of said upper section.

5. A marine riser for installation in a body of water having a great depth, the riser comprising:

a central tube for transferring a fluid including mud from a bottom of the body of water to an upper level thereof, peripheral lines connected to said riser;

an internal lining disposed in said central tube for reducing an amount of mud circulating in the riser, and float means provided solely along an axial length of an upper section of the central tube, wherein said internal lining is disposed coaxially with respect to said central tube and has a diameter less than a diameter of said central tube so as to define an annular space between an outer surface of said internal lining and an inner surface of said central tube, and wherein said riser is formed of a plurality of riser sections, and said internal lining is suspended from a corresponding interior lining of an adjacent riser section.

6. A marine riser for installation in a body of water having a great depth, the riser comprising:

a central tube means for transferring a fluid including mud from the bottom of the body of water to an upper level thereof, peripheral lines connected to said riser, an internal lining means disposed in said central tube means for reducing an amount of mud circulating in the riser, wherein said internal lining means is disposed coaxially with respect to said central tube means and has a diameter less than a diameter of said central tube means so as to define an annular space between an outer surface of said internal lining means and an inner surface of said central tube means, and wherein at least one of said central tube means and at least one of said peripheral lines has a weight less than an equivalent steel tube or steel peripheral line.

7. Riser according to one of claims 1, 2, or 6, wherein at least one of said central tube and at least one of said peripheral lines is at least partly fashioned of a low density metallic material.

8. Riser according to claim 7, wherein said low density metallic material is a titanium alloy.

9. Riser according to one of claims 2 or 6, further comprising a hooping reinforcement of at least one of a part of the central tube and at least one section of at least one of the peripheral lines.

10. Riser according to claim 9, wherein said hooping reinforcement includes a reinforcement strip wound around at least said section of said central tube and around at least said at least one section of at least one of said peripheral lines.

11. Riser according to one of claims 1 or 6, wherein said riser is formed of a plurality of riser sections, and wherein bayonet connector means are provided for connecting the riser sections to each other.

12. Riser according to one of claims 1, 2 or 6, wherein at least one of said central tube and at least one of said peripheral lines is formed of a composite material.

* * * * *